US008234982B2

(12) United States Patent
Parker

(10) Patent No.: US 8,234,982 B2
(45) **Date of Patent: *Aug. 7, 2012**

(54) SNOWBOARDER'S CHAIR FOR USE ON A SKI LIFT

(76) Inventor: Katharine West Parker, Salem, OR (US)

( * ) Notice: Subject to any disclaimer, the term of this patent is extended or adjusted under 35 U.S.C. 154(b) by 174 days.

This patent is subject to a terminal disclaimer.

(21) Appl. No.: 12/664,257

(22) PCT Filed: Jun. 5, 2008

(86) PCT No.: PCT/US2008/065948

§ 371 (c)(1), (2), (4) Date: Dec. 11, 2009

(87) PCT Pub. No.: WO2008/157063

PCT Pub. Date: Dec. 24, 2008

(65) Prior Publication Data

US 2010/0180791 A1 Jul. 22, 2010

Related U.S. Application Data

(63) Continuation-in-part of application No. 11/761,603, filed on Jun. 12, 2007, now Pat. No. 7,775,161.

(51) Int. Cl.
*B61B 11/00* (2006.01)

(52) U.S. Cl. ..... 105/149.2; 104/173.1; 104/173.2; 105/149.1

(58) Field of Classification Search ..... 104/112, 104/173.1, 173.2; 105/149.1, 149.2
See application file for complete search history.

(56) References Cited

U.S. PATENT DOCUMENTS

| | | | |
|---|---|---|---|
| 3,898,936 | A | 8/1975 | Spencer |
| 4,149,471 | A | 4/1979 | Tauzin et al. |
| 4,246,848 | A | 1/1981 | Schneider |
| 4,784,065 | A | 11/1988 | Brochand |
| 5,090,722 | A | 2/1992 | Ritchie et al. |
| 5,356,159 | A | 10/1994 | Butterfield |
| 5,564,729 | A | 10/1996 | Gomez et al. |
| 5,664,499 | A | 9/1997 | Kingsmill |
| 6,457,746 | B1 | 10/2002 | Schepers |
| 6,840,179 | B2 | 1/2005 | Begotti |
| 7,059,624 | B2 | 6/2006 | Compton |

FOREIGN PATENT DOCUMENTS

| | | | |
|---|---|---|---|
| FR | 2614858 | A1 | 11/1988 |
| JP | 3035441 | U | 12/1996 |
| JP | 2003-048532 | A | 2/2003 |

OTHER PUBLICATIONS

International Search Report issued on Oct. 31, 2008 corresponding PCT/US2008/065948.

*Primary Examiner* — S. Joseph Morano
*Assistant Examiner* — Zachary Kuhfuss
(74) *Attorney, Agent, or Firm* — James G. Passé; Passé Intellectual Property, LLC

(57) ABSTRACT

The present invention relates to a ski lift chair specifically designed for use by snowboarders. The chair comprises a plurality of seats facing perpendicular to the line of travel direction and can be either in-line back to back, in-line front-to-back or a combination of the two. The chair can be mixed on a ski lift with chairs designed for skiers or used alone with only snowboarder chairs.

9 Claims, 4 Drawing Sheets

SNOWBOARDER'S CHAIR FOR USE ON A SKI LIFT

This application is a continuation-in-part and claims priority from U.S. non-provisional application Ser. No. 11/761,603 filed on Jun. 12, 2007 now U.S. Pat. No. 7,775,161.

BACKGROUND OF THE INVENTION

1. Field of the Invention

The present invention relates to a chair for use on a ski lift. In particular, the present invention relates to a chair designed to safely load and unload snowboarders, which can be used on a standard ski lift cable.

2. Description of the Related Art

The ski lift in use today is similar to the function of ski lifts that have been in use now for decades. Typically, the ski lift has a number of spaced towers on which pulleys and/or guides are mounted. A cable is strung through the pulleys or guides from the embarkation point of the ski lift up to the disembarkation point on a mountain where the cable direction is reversed by use of a turntable which brings the cable back down the hill to start the process over again. In other words the cable is a continuous loop delivery system.

Normally, single user or multi user bench type chairs are hung from the cable at spaced intervals. The skier skies up to the approaching chair and as the chair approaches from behind, the skier sits on the chair. While there are some chairs that rotate during the travel portion of the journey, ski chairs are designed to pick up and deliver the skier in the direction of travel so that the skier can disembark the chair facing forward.

In U.S. Pat. No. 5,664,499 to Kingsmill, there is disclosed a standard skiers ski lift and multiple user ski chair (bench). The skiers ski up to the ski lift and the chair approaches from behind. As the chair reaches the skiers, the skiers sit down and ride the lift facing forward and disembark facing forward.

In U.S. Pat. No. 3,898,936 to Spencer there is disclosed a seating system for a ski tram. The seat is a single seat tram and the seat is oriented so that the user sitting in it faces the direction of travel and can unload in a generally forward facing direction.

In U.S. Pat. No. 4,246,848 to Schneider, there is disclosed a ski lift chair with a swivel mechanism that allows skiers to load and unload in a generally forward facing direction but permitting the passenger to orient the seat in any direction relative to travel during the middle portion of the travel. This is described as useful for putting ones back to the wind or to view the scenery as one travels up the mountain. The chair is automatically returned to the forward facing position during embarkation and disembarkation.

Snowboarding is a more recently developed downhill snow activity which combines motions of not only skiing but surfing and skateboarding as well. Snowboarding is practiced on a single board having two boot binding fixtures positioned such that when the board is facing down the hill one of the users shoulders is positioned downhill and the other uphill rather than the user facing directly downhill as when skis are pointed downhill or when riding the ski lift.

Skiers ride the ski lift with their skis on and can easily maintain balance when getting on and off the ski lift. In contrast to that, since snowboarders are forced to ride the ski lifts using today's available ski lift chairs and benches, they must use a different technique when loading and unloading from the ski lift than a skier. Snowboarders cannot easily face both feet down hill in order to sit on the ski lift bench in the direction of travel as skiers do. To approach the chair lift line, snowboarders free one foot (in most cases the back foot) from the board then scoot up to the ski lift. They sit on the ski lift bench with the snowboard held on by one boot and its binding while traveling up the ski lift. Not only does the dangling snowboard present risk of injury to the snowboarder from the increased weight on the ankle and the movement of the twisting snowboard as it dangles, there is some risk of losing the snowboard while riding, thus endangering skiers and snowboarders on the slopes below.

A more serious problem are reports of snowboarders falling off the ski lift while attempting to engage the loose binding while on the ski lift prior to disembarkation. Also for those who wait until they reach the disembarkation point to reattach the loose binding, they are then required to board away from the ski chair with only one foot attached to the snowboard. It is understandable then that the vast majority of injuries and falls from disembarkation are from snowboarders and not skiers.

A number of approaches have been attempted to improve the safety of snowboarders while riding the ski lift. In U.S. Pat. No. 5,090,722 to Ritchie, et al., there is disclosed a device for temporarily gripping the booted foot to provide steering control with the loose foot. This primarily aids with disembarkation but is not an entire fix and does not address issues for getting on and riding the lift.

In U.S. Pat. No. 5,356,159 to Butterfield there is described a brace, shaped and dimensioned to receive the tip of a snowboard riding boot swivelingly mounted on the top surface of the snowboard to facilitate the carrying of the snowboard while riding the ski lift. This device helps with the dangling snowboard problem but does not aid with boarding or disembarking the ski lift.

Another more complex approach is described in U.S. Pat. No. 5,564,729 to Gomez et al. The Gomez patent describes a tether and support for a snowboard including an adjustable support strap that is connected to a harness worn on the body of the snowboarder to support the weight of the snowboard while riding the lift. This device provides some stability when disembarking but there is still a foot loose during use and the device is exceedingly bulky such that it is unlikely to be used by the recreational snowboarder.

In U.S. Pat. No. 6,457,746 to Schepers there is described a tether for supporting a snowboard during the chair lift ride. This device is permanently attached to the chair lift and does nothing to aid the snowboarder getting on or off the ski lift. Lastly, U.S. Pat. No. 7,059,624 to Compton discloses a toe-hook apparatus to relieve stress on the knees and ankles while riding the chair lift with one foot out of the snowboard.

Currently, there is no solution to the continuing problem of snowboarders embarking and disembarking when riding a ski lift. Clearly there exists a need for a way for snowboarders to ride the current ski lift system with greater safety during the embarking and disembarking process. Also, there is a need for a system to allow snowboarders to disembark from a ski lift with both feet attached to the snowboard. Clearly there exists a need for a device to safely facilitate the transportation of snowboarders from embarkation to disembarkation.

SUMMARY OF THE INVENTION

It has been discovered in the present invention, a chair and ski lift with a chair capable of transporting a snowboarder up a ski mountain that allows them to be transported in the same direction of their travel and allow for them to disembark the chair with both feet attached to the snowboard.

In one embodiment the invention relates to a ski lift chair for transporting snowboarders on a ski lift comprising:

a) a means for hanging the chair on a ski lift cable;

b) a plurality of independent seats, each seat positioned in-line relative to one another and facing essentially perpendicular to the intended direction of travel of the chair during embarkation and disembarkation;

the seats spaced such that when the chair is in use, a snowboarder may be positioned on a snowboard facing essentially perpendicular to the direction of travel of the chair during embarkation and disembarkation and sit on the seat when the seat is behind the snowboarder.

In yet another embodiment of the invention there is disclosed a ski lift comprising:

a) a ski lift cable positioned along a lift path between an embarkation and a disembarkation point;

b) at least one ski lift chair hung from the ski lift cable comprising a plurality of independent seats, each seat positioned in-line relative to one another and facing essentially perpendicular to the lift path at the embarkation and disembarkation points, wherein the seats are spaced such that a snowboarder may be positioned perpendicular to the lift path at the embarkation point and sit on the seat when the seat is behind the snowboarder.

These and other objects of the present invention will be clear to one skilled in the art when taken in view of the detailed specification and disclosure in conjunction with the appended figures.

DETAILED DESCRIPTION OF THE INVENTION

Figure 1:
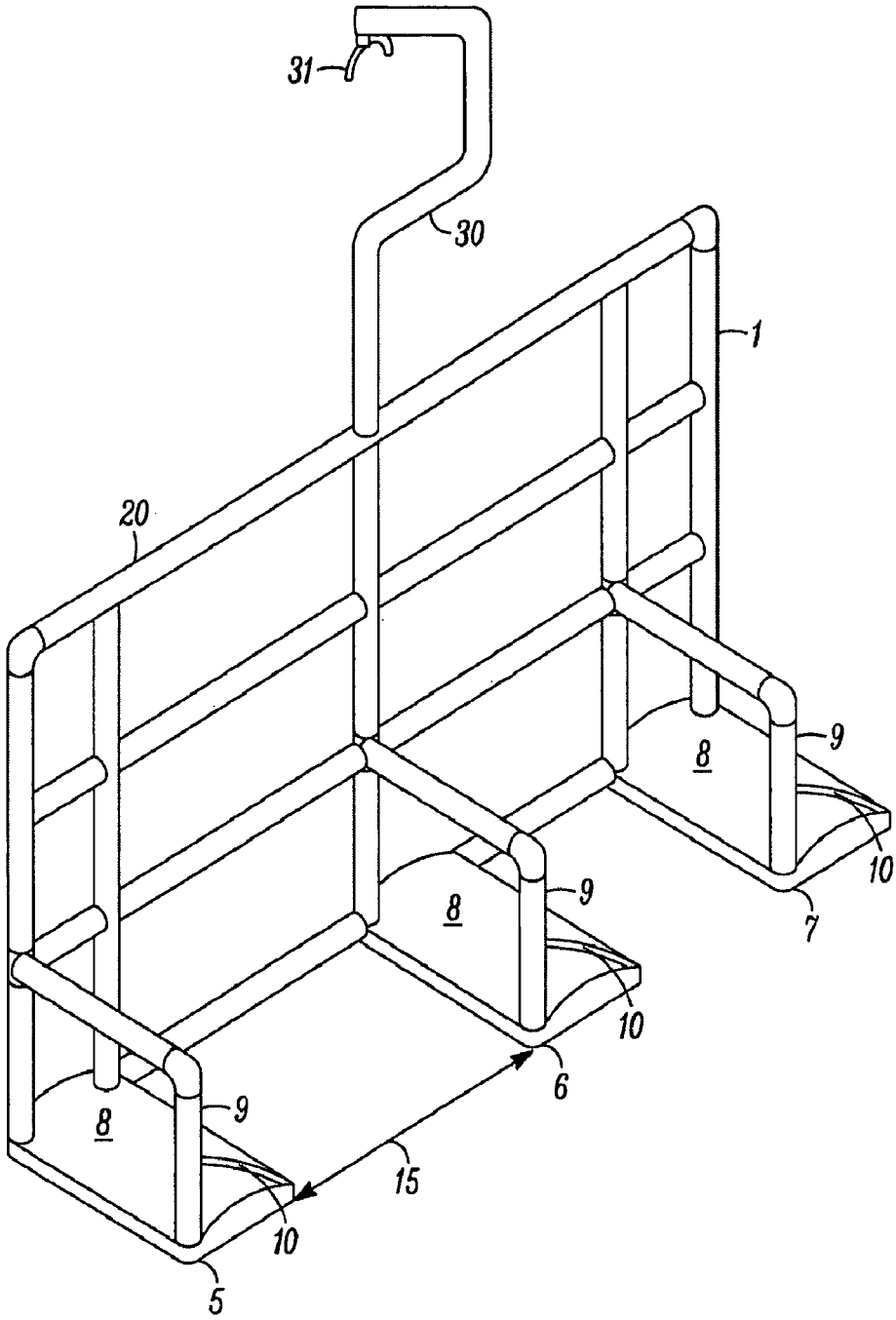
FIG. 1 is a front angle perspective of a snowboarder chair of the invention.

The general description of the invention including the chair and ski lift of the invention are stated in the Brief Summary above. This detailed description defines the meaning of the terms used herein and specifically describes specific embodiments shown in the figures in order for those skilled in the art to practice the invention.

As used herein a "means for hanging the chair on a ski lift cable" refers to the known means for attaching known ski lift chairs to the ski lift cable such that the chair hangs below the cable. See, for example, the ski chairs cited above, each of which is hereby incorporated by reference. One embodiment of this is shown in the drawings but the cited prior art also discloses several versions of hanging means including ones where the chair is rotatable during travel and can return to a given position during embarkation and disembarkation. In any event, any means for hanging the chair from the ski cable is included herein by reference to those hanging means in the art and to any developed means for so hanging a chair.

As used herein a "ski lift chair for transporting snowboarders on a ski lift" refers to a chair designed to be hung from the transport cable of a standard ski lift. Normally chairs are designed for use with skier chairs, that is, with chairs designed with a skier in mind in terms of embarkation and disembarkation. A chair with snowboarders as the primary focus involves a redesign of the chair such that snowboarders may use the chair on a ski lift with the benefit of being able to disembark with both feet attached to the snowboard, reducing not only the number of falls during disembarkation, but also the number of immobile snowboarders at the dismounting area, both of which cause injurious and costly accidents. Such new design will greatly reduce injuries due to embarkation and disembarkation falls and as such is a great improvement in the industry.

As used herein "a plurality of independent seats" refers to the fact that unlike typical multi-user ski chairs which are a bench style seating chair (for example, as shown in U.S. Pat. No. 5,664,499 previously disclosed), the seats of the present invention give each snowboarder his own independent or separate seat. This is so, even though the chairs of the present invention having 2 or more seats will be mounted on a single chair, i.e. a plurality of seats on a single chair. As particular embodiments of the present invention, the chair could be outfitted with 2, 3, 4, 5 or more seats depending on the individual weight capacity of the ski lift; the room on the ski lift and ski lift cable. In addition in some embodiments the single chairs can be combined with a seat or bench to provide seating for a skier. One skilled in the art armed with the detailed description herein could easily determine the ideal number of seats on each chair for the particular ski lift apparatus. As used herein therefore, "chair" refers to the whole device that is hung from the cable of a ski lift including the hanging device and the seats that comprise the individual chair. This concept will be made even clearer upon inspection of the specific embodiment of the figures.

As used herein the phrase "positioned in-line relative to one another" refers to the fact that the seats of the present invention are arranged in a straight line, either front to back, back-to-back, or a mixture of the two as opposed to side by side as is seating on a bench type seat. Thus, the seats together on a single chair are arranged parallel to the normal embarkation line that skiers and snowboarders must line up on when embarking on the standard ski lift. This arrangement allows all the snowboarders for that particular chair to sit at the same time. Other arrangements would be dangerous as a single person sitting may start the chair swinging and cause other people trying to sit a fraction of a second later to misjudge where to sit.

Figure 4:
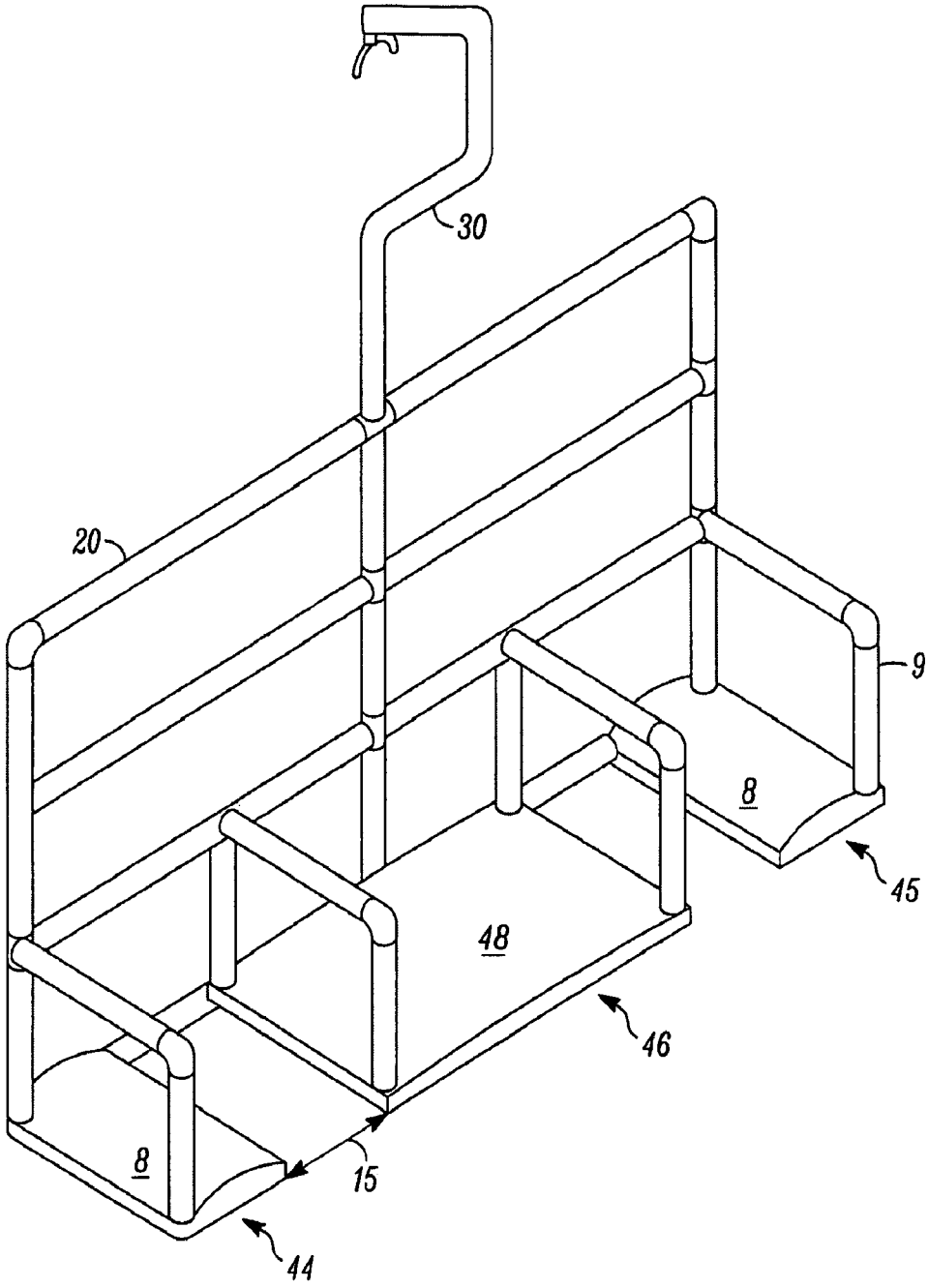
FIG. 4 is a perspective view of a combination seat with both skier and snowboarder seats.

The seats are spaced in the present invention such that there is enough room between each individual seat to allow the snowboarder standing on their snowboard facing perpendicular to the line of travel, to have enough room to fit in-between the chairs before sitting thereon. As the chair of the invention approaches, the snowboarder stands so positioned, and as the mounting back of the chair reaches the snowboarder, the snowboarder can sit. Also, there must be enough room such that slight misjudgments in where the snowboarder should stand will not result in one of the seats hitting the snowboarder and allow easy entry in-between each seat. In the situation where there are back to back seats, it is possible to have two seats facing one another. The spacing in that case would need to be appropriately wider to accommodate 2 snowboarders standing face-to-face prior to sitting. Other spacing may be necessary in the event of combination chairs having both snowboarder and skier seats as shown in FIG. 4. In that case the spacing would only need to be enough to accommodate a single snowboarder.

As used herein, the term embarkation point refers to the point where a snowboarder stands to be able to sit on a ski lift chair of the invention or any other ski lift in the art. Likewise the disembarkation point is the point at the top of the mountain where the snowboarders leave the chair and board away from the ski lift. Both of those points are normally marked as a line parallel to the direction of travel of the ski lift cable making it easy to know where to stand while waiting for the next appropriate chair to arrive.

One of the elements of embodiments of this present invention is that by positioning the seats facing perpendicular to the line of travel of the ski lift cable, a snow boarder may board up to the embarkation point and wait facing perpendicular to the line of travel of the ski lift cable as opposed to removing one foot from the board and standing facing the line of travel. The snowboarder may then sit down facing perpendicular to the line of travel as well as disembark boarding right off the chair of the present invention. In the case of a combination chair skiers would face forward and snowboarders would face perpendicular to the line of travel to embark in the chair.

The chair of the present invention can be sold as an add-on to an existing ski lift or can be sold as a component of a new ski lift thus giving the ski lift operator flexibility in either retrofitting an existing facility or purchasing an entirely new ski lift. This is aided by the fact that, as previously described, the chair of the present invention is fitted with a standard means for attaching the chair to a ski lift cable.

Now referring to the drawings: FIG. 1 depicts an angle perspective of a particular embodiment of the present invention. This embodiment of snowboard chair 1 depicts the invention with three seats 5, 6 and 7. As can be readily seen in the figure seats, 5, 6 and 7 are arranged in a front to back in line arrangement. A Snowboarder sitting in seat 5 would be looking at the back of a snowboarder sitting in seat 6. Each seat 5, 6 and 7 consists further of a sitting area 8, a back rest 9 and in this embodiment arm rest 10. It should be noted that while other known ski lift chair features could be incorporated into embodiments of the present invention, they have been left out for clarity and detail of the invention itself. So, for example, safety bars, foot rests, other arm rests, wind guards and the like could be included with each of the depicted seats 5, 6 and 7.

Figure 3:
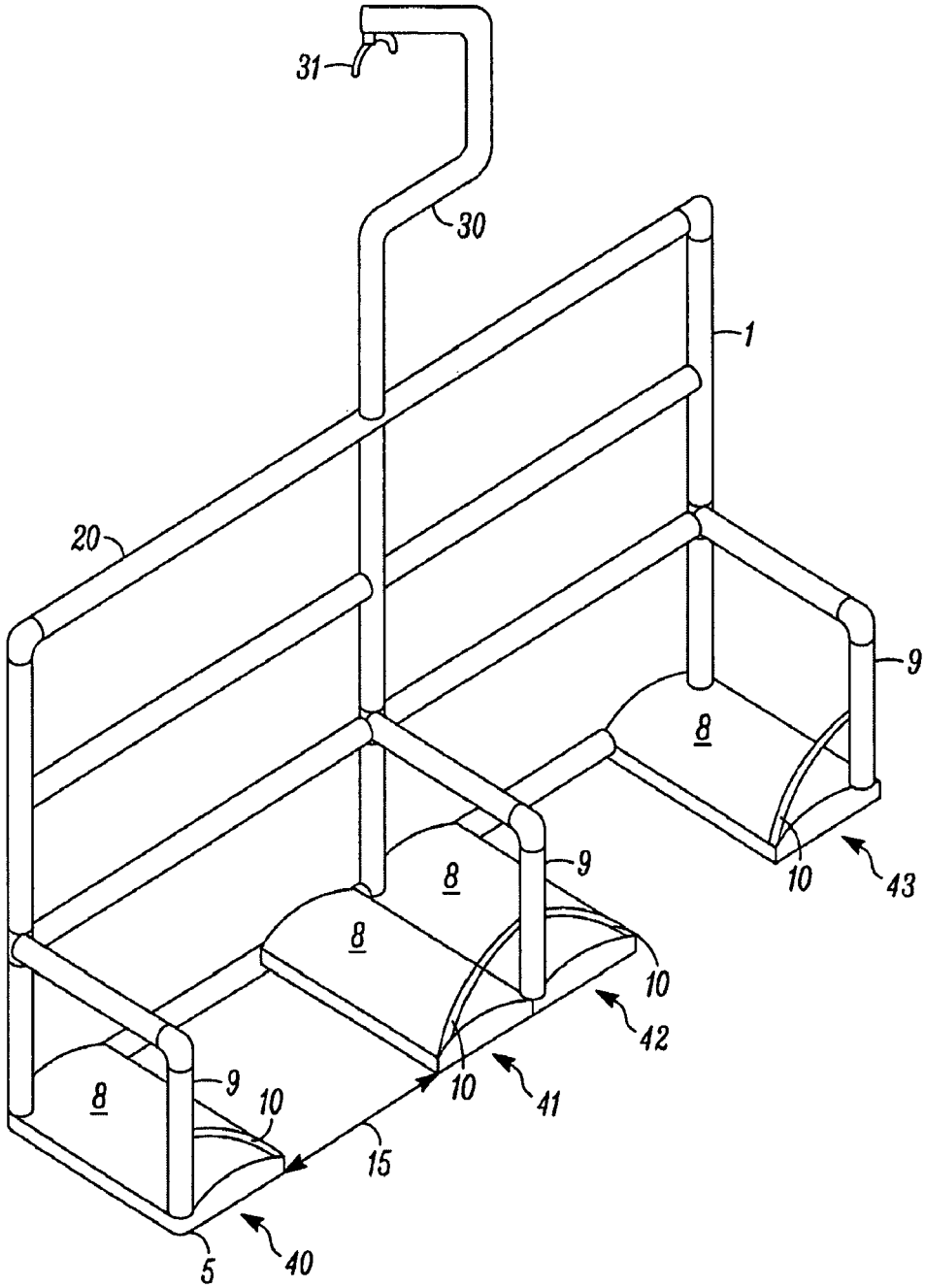
FIG. 3 is an angle perspective of a ski lift snowboarder chair with back-to back positioning.

Each of seats 5, 6 and 7 are spaced apart a given distance indicated by separation arrow 15. In general the distance between seats should be at least about 8 inches but could be more or less as needed to accommodate the anticipated snowboarder or snowboarders in the case of face-to-face seating as seen in FIG. 3. The actual distance may vary with the width of the chair and number of seats on the chair, but in general, this distance, as described above, is designed to allow enough room at a minimum to allow a snowboarder to enter the space from the right or left side for sitting directly on the seat. This is, of course, not an issue with seat number 7 but care still needs to be taken to make sure the snowboarder does not need to stand outside of the designated embarkation point.

Each of seats 5, 6 and 7 are spatially mounted on mounting back 20. Mounting back 20 is designed to give structure and rigidity to the whole chair 1 as well as providing a mounting point for each of the individual seats. Mounting back 20 is also position such that the snowboarder can sit once the mounting back 20 reaches the stationary snowboarder waiting for the chair 1. In addition, mounting back 20 can be used as an attachment point for ski lift cable hanger 30. Cable hanger 30 is a means for attaching a chair to a ski lift. As is well known in the art, a number of different hangers are known in the art and can be used with the present invention. In the present embodiment cable hanger 30 is rigid and outfitted with cable attachment means 31; however, other mobile hangers and other attachment means to a ski lift cable are certainly within the skill of the art and contemplated by the present invention.

Seats 5, 6 and 7 could be hard or padded seats and are normally constructed such that they will accommodate the average snowboarder. Likewise, the entire chair 1 can be constructed of any material normally used to construct a ski lift chair designed for skiers. So, for example, aluminum, treated steel, alloys as well as plastics and fiber materials can be used by one skilled in the art of the particular invention.

Figure 2:
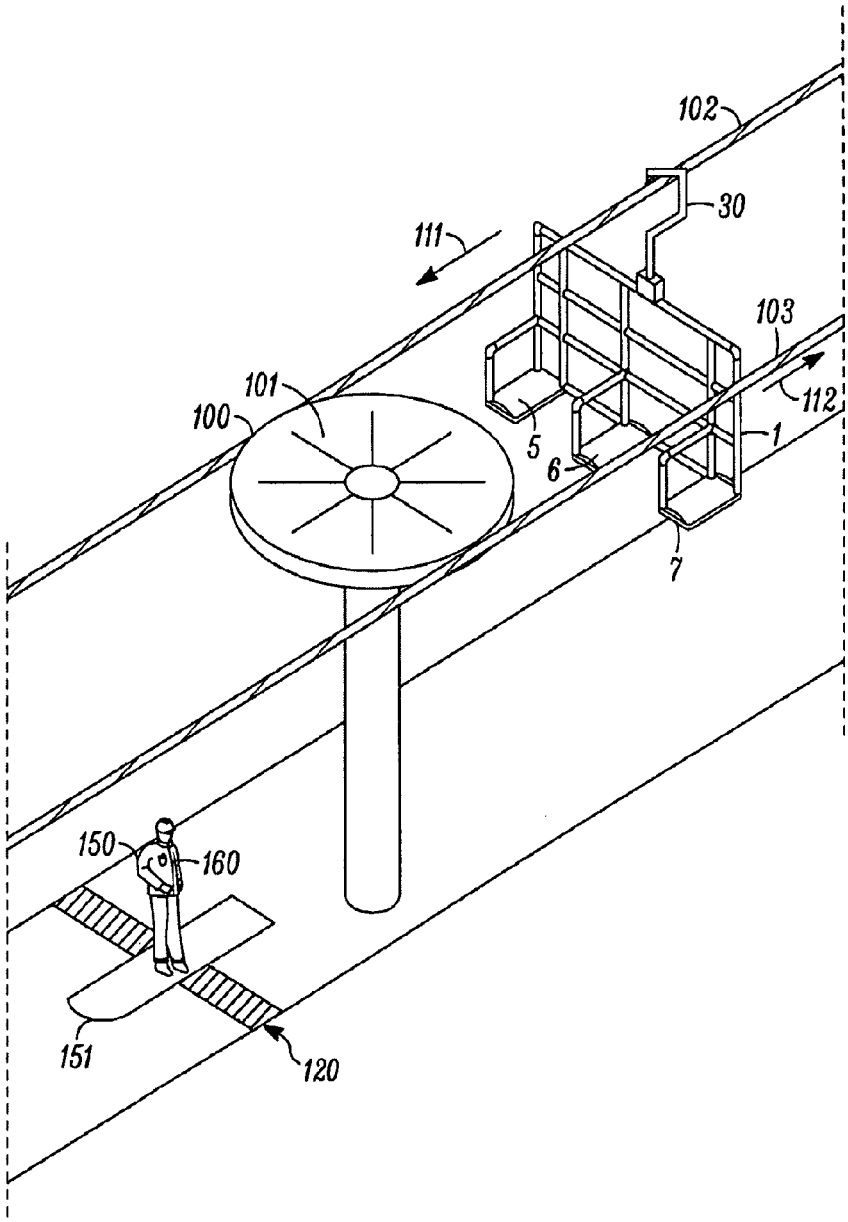
FIG. 2 is an angle perspective of a ski lift with snowboarder chair of the invention.

FIG. 2 shows an embodiment of the invention where a chair of the invention chair 1 is hung from ski lift 100. Only a portion of a ski lift is shown and in this FIG. 2, a turntable 101 is shown as well as uphill moving cable 102 and downhill moving cable 103 are depicted. Arrow 111 indicates the uphill direction of travel of cable 102 while arrow 112 indicates the downhill direction of travel of cable 103. What is not shown is the continuous loop of the cable or the top of mountain portion of the ski lift. Represented in FIG. 2 is the embarkation portion of a ski lift with approaching chair 1, which is moving in the same direction as cable 102.

Embarkation Area 120 is the position on the ground where skiers or in the case of the present invention snowboarders would stand and wait for a chair 1 one to approach. In the Figure, snowboarder 150 is shown standing on a snowboard with both feet attached to the snowboard 151. Snowboarder 150 is facing perpendicular to the direction of cable 102 with snowboarders left shoulder 160 facing the approaching chair 1. Snowboarder 150 is positioned to sit on middle seat 6. As the chair 1 approaches, snowboarder 150 will fit in-between seats 6 and 7, eventually sitting down on chair 6 maintaining the perpendicular facing orientation. Upon disembarkation snowboarder 150 need only stand at the disembarkation point and board away from chair 1. In the case of multiple users a user could be positioned for sitting in each of the three seats 5, 6 and 7 for riding up the mountain on chair 1.

As can be readily seen from the FIG. 2, the chair 1 is hung on cable 102 via hanger 30. Because chairs for skiers as well as snowboarders are hung in the same manner, chair 1 can be interspersed with spatially positioned skiers chairs or the entire ski lift can be hung with chairs of the invention. Clearly, where a mountain is used by both skiers and snowboarders, the availability of hanging both types of chairs is a tremendous advantage over currently available systems. Also, the ability to quickly and easily remove both types of chairs means the ski lift owner can make a decision to vary the mix of chair types on a daily basis, if need be.

FIG. 3 depicts a perspective view of the present invention with in-line back-to-back seating. In this embodiment of the invention seats 40, 41, 42 and 43 are shown in a mix of in-line and back-to-back configuration. Seats 41 and 42 are positioned in back-to-back position but it can be seen that the seats are still all in-line, and when hung, the whole chair 1 will be positioned such that the four seats 40, 41, 42, and 43 are essentially perpendicular to the line of travel of chair 1. The seat back 9 that is in-between seats 41 and 42 becomes the back for both of those seats due to the back-to-back positioning as opposed to the seats in FIG. 1 where each seat has its own back 9. This embodiment still has spacing 15, which will need to accommodate two snowboarders standing face-to-face in order to sit on the seats at the same time.

FIG. 4 depicts two snowboard seats 44 and 45 of the present invention in combination with a bench seat 46 for use by two skiers. The seat area 48 provides a forward facing seat so that the skier may sit down in a normal fashion for skiers. At the same time the two seats 44 and 45 of the present invention are facing each other perpendicular to the direction of travel. By providing a combination chair both skiers and snowboarders can ride in the chair without having to wait for a particular chair.

The above interests in ski lifts and chairs for snowboarders are explained and met as can be seen readily from the disclosure which follows and thus met by the present invention. One skilled in the art can readily change materials, shapes and designs within the teaching in the examples and present invention and, as such, the examples and figures are not intended to be limiting but merely exemplary.

What is claimed is:

1. A ski lift chair for transporting snowboarders on a ski lift comprising:

a) a means for hanging the chair on a ski lift cable;

b) a plurality of independent seats, each seat positioned in-line relative to one another and facing essentially perpendicular to an intended direction of travel of the chair during embarkation and disembarkation; and c) at least one forward facing seat designed to accommodate a skier;

the independent seats spaced such that when the chair is in use, a snowboarder may be positioned on a snowboard facing essentially perpendicular to the direction of travel of the chair during embarkation and sit on the independent seat when the independent seat is behind the snowboarder.

2. A ski lift chair according to claim 1 wherein the independent seats are arranged in a front to back configuration.

3. A ski lift chair according to claim 1 wherein the independent seats are arranged in a back to back configuration.

4. A ski lift chair according to claim 1 wherein the independent seats are arranged in a combination of front to back and back-to-back.

5. A ski lift comprising:

a) a ski lift cable positioned along a lift path between an embarkation and a disembarkation point;

b) at least one ski lift chair hung from the ski lift cable designed for snowboarders comprising a plurality of independent seats, each independent seat positioned in-line relative to one another and facing essentially perpendicular to the lift path at the embarkation and disembarkation points, wherein the independent seats are spaced such that a snowboarder may be positioned perpendicular to the lift path at the embarkation point and sit on the seat when the independent seat is behind the snowboarder; and c) at least one forward facing seat designed to accommodate a skier.

6. A ski lift according to claim 5 wherein the independent seats are positioned in a front-to-back configuration.

7. A ski lift according to claim 5 wherein the independent seats are positioned in a back-to-back configuration.

8. A ski lift according to claim 5 wherein the independent seats are positioned in a combination of front-to-back and back-to-back configuration.

9. A ski lift according to claim 5 wherein there is a combination of chairs for skiers and snowboarders on the ski lift cable.

* * * * *